US005383986A

United States Patent [19]

Cho

[11] Patent Number: 5,383,986

[45] Date of Patent: Jan. 24, 1995

[54] METHOD OF IMPROVING TRANSVERSE DIRECTION MECHANICAL PROPERTIES OF ALUMINUM-LITHIUM ALLOY WROUGHT PRODUCT USING MULTIPLE STRETCHING STEPS

[75] Inventor: Alex Cho, Richmond, Va.

[73] Assignee: Reynolds Metals Company, Richmond, Va.

[21] Appl. No.: 30,925

[22] Filed: Mar. 12, 1993

[51] Int. Cl.[6] ..... C22F 1/04

[52] U.S. Cl. ..... 148/697; 148/415; 148/416; 148/417; 148/418; 148/698; 148/699; 148/700; 148/701; 148/702; 148/437; 148/438; 148/439; 148/440

[58] Field of Search ..... 148/415, 416, 417, 418, 148/697, 6998, 699, 700, 701, 702, 437, 438, 439, 440

[56] References Cited

U.S. PATENT DOCUMENTS

| | | | |
|---|---|---|---|
| 4,077,813 | 3/1978 | Fletcher et al. | 148/697 |
| 4,648,913 | 3/1987 | Hunt, Jr. et al. | 148/415 |
| 4,790,884 | 12/1988 | Young et al. | 148/415 |
| 4,806,174 | 2/1989 | Cho et al. | 148/415 |
| 4,861,391 | 8/1989 | Rioja et al. | 148/701 |
| 5,019,183 | 5/1991 | Martin | 148/415 |
| 5,032,359 | 7/1991 | Pickens et al. | 148/417 |

*Primary Examiner*—Melvyn J. Andrews
*Assistant Examiner*—Robert R. Koehler
*Attorney, Agent, or Firm*—Alan M. Biddison

[57] ABSTRACT

Strength and ductility for a aluminum-lithium alloy wrought product in the transverse direction is improved by subjecting these types of alloys to improved T8 temper practice. The wrought product, after solution heat treating and quenching is subjected to a multiple step stretching sequence prior to aging, the total percent reduction for the multiple step stretching sequence ranging between 1 and 20 percent reduction. In the multiple step stretching sequence, each of the stretching steps may have the same or different amounts of percent reduction to achieve the desired total percent reduction. An aluminum-lithium alloy wrought product subjected to the improved T8 temper practice has increased tensile yield stress and percent elongation in its transverse direction to facilitate commercial application of the product in high strength applications.

19 Claims, 3 Drawing Sheets

METHOD OF IMPROVING TRANSVERSE DIRECTION MECHANICAL PROPERTIES OF ALUMINUM-LITHIUM ALLOY WROUGHT PRODUCT USING MULTIPLE STRETCHING STEPS

FIELD OF THE INVENTION

The invention is directed to improving mechanical properties of aluminum-lithium alloy wrought product by subjecting a solution heat treated wrought product to a multiple step stretching sequence prior to aging.

BACKGROUND ART

In many industries, such as the aerospace industry, one of the effective ways to reduce the weight of an aircraft is to reduce the density of aluminum alloys used in the aircraft's construction. It is known in the art that aluminum alloy densities may be reduced by the addition of lithium. However, lithium in aluminum-based alloys also raises other problems. For example, the addition of lithium to aluminum alloys may result in a decrease in ductility and fracture toughness. For use as aircraft structural parts, it is obviously imperative that any alloy have excellent fracture toughness and strength properties.

Various aluminum-lithium alloys have been registered with the Aluminum Association. For example, alloys AAX2094 and AAX2095, registered in 1990, include alloying elements of copper, magnesium, zirconium, silver, lithium and inevitable impurities.

U.S. Pat. No. 5,032,359 to Pickens et al , issued Jul. 16, 1991, discloses an improved aluminum-copper-lithium-magnesium-silver alloy possessing high strength, high ductility, low density, good weldability and good natural aging response. Typically, these alloys consist essentially of 2.0–9.8 wt.% of an alloying element which may be copper, magnesium, or mixtures thereof, the magnesium being at least 0.01 wt.% with about 0.01–2.0 wt.% silver, 0.05–4.1 wt.% lithium, and less than 1.0 wt.% of a grain refining additive which may be zirconium, chromium, manganese, titanium, boron, hafnium, vanadium, titanium di-boride or mixtures thereof.

Another prior art alloy for use in aircraft industry application is disclosed in U.S. Pat. No. 4,648,913 to Hunt, Jr. et al. In this patent, an aluminum-based alloy is disclosed comprising 0.5–4.0 wt.% lithium, 0–5.0 wt.% magnesium, up to 5.0 wt.% copper, 0–1.0 wt.% zirconium, 0–2.0 wt.% manganese, 0–7.0 wt.% zinc, 0.5 wt.% maximum iron, 0.5 wt.% maximum silicon, the balance aluminum and incidental impurities. This alloy is subjected to heat treating and working steps to improve strength and toughness characteristics. The heat treating and working steps of Hunt, Jr. et al are representative of a T8 temper designation, that is well known to those skilled in the art, which includes solution heat treatment followed by strain hardening and then artificial aging. Related patents include U.S. Pat. Nos. 4,797,165 and 4,897,126 to Bretz et al and 4,961,792 to Rioja et al.

Despite the years of developmental effort, these newly commercialized aluminum-lithium alloys have been selected for relatively few commercial applications. One of the reasons for such a limited commercial success of these aluminum-lithium alloy products is that aluminum-lithium alloys in wrought product form tend to develop very high texture which adversely affects the mechanical properties of the wrought product in the transverse direction. These mechanical property limitations often prevent the implementation of aluminum-lithium alloys in full scale commercial aircraft structural applications.

While poor mechanical properties such as ductility in aluminum-lithium wrought products in the transverse direction are typical for all forms of wrought products, the poor transverse ductility and/or strength are especially prominent in aluminum-lithium extrusions. These ductility and/or strength deficiencies are especially pronounced in extruded product having axisymmetric cross sections.

In the aforementioned Hunt, Jr. et al. '913 patent and related U.S. Pat. Nos. 4,790,884 to Young et al. and 4,861,391 to Rioja et al., solution heat treatment, stretching and aging steps are disclosed to improve various mechanical properties in aluminum-lithium alloys. In the Hunt, Jr. et al patent, the solution heat treated and quenched product is subjected to a single stretching step in an amount greater than a 3% stretch or a working effect equivalent to stretching greater than 3%. However, these types of T8 temper practices are deficient in providing acceptable mechanical properties in the transverse direction. As will demonstrated herein below, unacceptable levels of ductility and strength are evident using these types of conventional practices.

As such, a need has developed to provide improved processing techniques to achieve high strength and ductility in aluminum-lithium alloy wrought products to facilitate their use in aircraft structural applications.

In response to this need, the present invention provides a method of improving the mechanical properties of aluminum-lithium alloys in the transverse direction by imparting a plurality of stretching steps between solution heat treating and aging. None of the prior art discussed above teaches or fairly suggests improving transverse direction mechanical properties in these types of alloys by modifying conventional T8 temper practice in this manner.

The patent to Rioja et al discussed above teaches a two-step aging method for aluminum-lithium alloys. One or both of the aging steps may be preceded by a stretching step in an amount between about 1 to 8 percent.

In the aforementioned patent to Young et al, a method is disclosed for making aluminum-lithium alloy flat rolled product capable of being stretched without the formation of luders lines. In this method, the flat rolled product is preaged prior to stretching. Optionally, a controlled cold working may be employed after solution heat treating and prior to the thermal preaging treatment.

Neither of the patents to Young et al nor Rioja et al teach or fairly suggest improving transverse direction mechanical properties in aluminum-lithium alloy wrought product using a multiple step stretching sequence between the steps of solution heat treating and quenching the wrought product and aging to a predetermined strength level.

SUMMARY OF THE INVENTION

It is a first object of the present invention to provide a method for improving mechanical properties of aluminum-lithium wrought product in the transverse direction.

Another object of the present invention is to provide a method of improving strength and ductility in the transverse direction for aluminum-lithium alloy extrusions, in particular, extrusions of various and axisymmetrical cross section.

Another object of the present invention is to provide an aluminum-lithium alloy wrought product exhibiting improved ductility and tensile and yield stress by subjecting a solution heat treated and quenched wrought product to a multiple step stretching sequence prior to aging.

Other objects and advantages of the present invention will become apparent as the description thereof proceeds.

In satisfaction of the foregoing objects and advantages, the present invention comprises an improvement over prior art methods of producing aluminum-lithium wrought products that include the steps of solution heat treating, strain hardening and aging. In the inventive process, the strength and ductility in the transverse direction of a solution heat treated and quenched aluminum-lithium wrought product are improved by stretching the solution heat treated and quenched product an amount between 1 and 20% reduction in a plurality of stretching steps. The stretched product is then aged to a given strength level such that the end product has increased strength and ductility in the transverse direction.

In one mode of the inventive process, the plurality of stretching steps are performed with equal amounts of percent reduction. For example, four stretching steps, each having a 1.5% reduction, may be used to obtain a total of 6 percent reduction for a given wrought product.

In another mode of the inventive process, at least two of the plurality of stretching steps are unequal in percent reduction. In this mode, for example, one stretching step may be performed at 3.5% reduction with a second step having a 2.5% reduction for a total amount of cold work equaling 6% reduction.

The inventive method also produces an aluminum-lithium wrought product having improved strength levels and ductility in the transverse direction. The inventive method is especially directed to aluminum-lithium wrought products such as extrusions having complex or axisymmetrical cross sections.

BRIEF DESCRIPTION OF THE DRAWINGS

Reference is now made to the drawings accompanying the application wherein.

DESCRIPTION OF THE PREFERRED EMBODIMENTS

Figure 1:
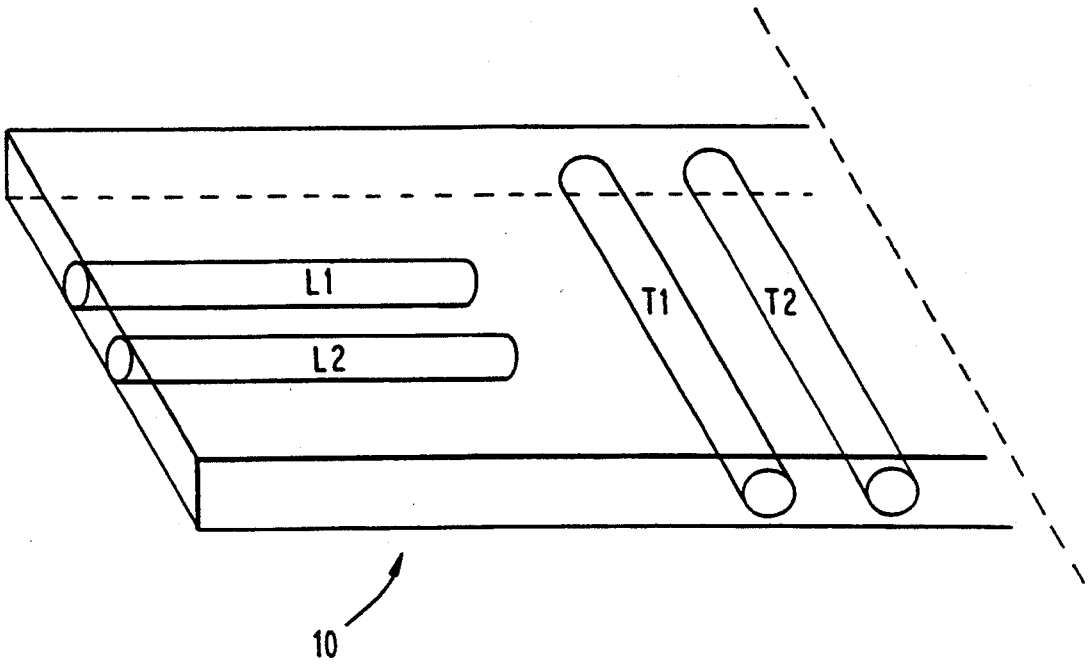
FIG. 1 is a perspective view of an aluminum-lithium wrought product processed according to a first mode of the inventive method.

The present invention overcomes deficiencies in aluminum-lithium wrought alloy products, in particular, extrusions having low levels of ductility and strength in the transverse direction. Aluminum-lithium wrought product when subjected to conventional T8 temper practice achieves only limited benefits with respect to increased strength and ductility in the transverse direction. This poor ductility and strength prevent these types of aluminum-lithium wrought alloy products from being fully utilized in commercial applications such as aircraft structural components.

The present invention produces an aluminum-lithium wrought alloy product having improved ductility and strength in the transverse direction. This improvement in strength and ductility results in a reduction in the difference between strength and elongation values between the longitudinal and transverse direction of the alloy wrought product. Thus, aluminum-lithium wrought alloy products processed according to the present invention provide higher tensile and yield stresses throughout the thickness of the wrought product as well as in different directions.

The inventive method is especially suited for extruded products, and in particular, extruded products having axisymmetric or low aspect ratio cross sections. In these types of wrought products, poor transverse ductility and/or strength is even more pronounced. Subjecting these types of extruded products to the inventive process results in improvements in strength and ductility which cannot be achieved when using conventional processing to enhance strength and ductility. Thus, aluminum-lithium alloy wrought products processed according to the inventive process are more attractive for commercial applications since the minimum design strength and elongation have been effectively increased.

In its broadest sense, the present invention is an improvement over conventional T8 temper practice. In conventional practice, an aluminum alloy wrought product is solution heat treated, quenched, strain hardened and aged to achieve a desired strength level. Prior art strain hardening steps include a single stretching and unloading step in amounts between 1 and 14% reduction.

As an improvement over the conventional practice, it has been discovered that strain hardening the aluminum-lithium alloy wrought product using a plurality of stretching steps between the solution heat treating and quenching step and the aging step improves strength and ductility in the transverse direction. The total amount of cold work performed by the multiple step stretching sequence ranges between 1 and 20% reduction. A more preferred total amount of cold work ranges between about 2 and 14% reduction. Most preferably, the total amount of cold work ranges between about 3 and 10% reduction.

In one mode of the inventive method, the aluminum-lithium alloy wrought product can be subjected to multiple stretching steps wherein each stretching step performs an equal amount of cold work. For example, a 6% reduction target of cold work can be obtained in two stretching steps of 3% reduction.

In another mode of the inventive method, unequal amounts of cold work can be performed in the multiple stretching steps to obtain the desired target amount of cold work. For example, an 8% reduction cold work target can be divided between three steps, one step of 4% reduction and two steps of 2% reduction. Alternatively, a 5% cold work target can be divided between two steps, one step having a 2% reduction with the other step having a 3% reduction.

It is believed that the inventive process is adaptable for any aluminum-lithium alloy product capable of achieving desired strength properties when subjected to T8 temper practice. For example, ternary alloys such as aluminum-lithium-copper or -magnesium may be subjected to the inventive processing. Other more complex alloys such as an aluminum-lithium-copper-magnesium alloy with or without additional alloying elements such as zirconium, silver and/or zinc may also be utilized with the present invention. These types of alloys would also include impurity elements such as iron, silicon and other inevitable impurities found in aluminum-lithium alloys.

More preferred alloys are the aluminum-lithium alloys including copper, magnesium and zirconium as main alloying components. An alloy exemplary of this class of alloys includes an AAX2094 alloy registered with the Aluminum Association. This alloy typically includes about 4.4 to 5.2% copper, 0.10% maximum manganese, 0.25–0.6% magnesium, 0.25% maximum zinc, 0.04–0.18% zirconium, 0.25%–0.6% silver, 0.8–1.5% lithium with the remainder iron, silicon, inevitable impurities and aluminum. Of course, this alloy represents an example of the various types of aluminum-lithium alloys adaptable for the inventive process.

The preparation of aluminum-lithium alloy wrought products for processing according to the improved T8 temper practice are well known in the art. That is, the alloy may be provided as an ingot or billet which may be preliminarily worked or shaped to provide suitable stock for subsequent working operations. Prior to the principle working operation, the alloy stock is preferably subjected to stress relieving, sawing and homogenization. The homogenization may be conducted at temperatures in the range of 900°–1060° F. for a sufficient period of time to dissolve the soluble elements and homogenize the internal structure of the metal. A preferred homogenization residence time includes 1–30 hours, while longer times may be used without adverse effect on the product. Homogenization is also believed to precipitate dispersoids to help control and refine the final grain structure. The homogenization can be done at either one temperature or at multiple steps utilizing several temperatures.

After homogenization, the metal can be rolled, stretched, extruded or otherwise worked to produce stock such as sheet, plate, an extrusion or other stock suitable for shaping into an end product. Extruded stock may include extruded rectangular bars, channel extrusions or the like. Typically, the alloyed is hot worked after homogenization to form a desired product. For extrusions, billet temperatures, cylinder temperatures and extrusion speed may be utilized as are commonly known in the prior art.

Following the working step, the product is solution heat treated from less than an hour to several hours at a temperature from 930° F. to about 1030° F. To provide increased strength and fracture toughness in the final product, it is usually also necessary to rapidly quench the solution heated product to prevent or minimize uncontrolled precipitation of the strengthening phases in the alloy. Typically, this quenching step involves cold water quenching to a metal temperature of 200° F. or less. Other quenching medium may be used depending on the final strength requirement for the wrought product.

The aging times and temperatures for the inventive process may vary dependent upon the desired strength levels in the final wrought product. Temperatures may range from about 250° F. up to 360° F. The time period for aging can range from one to up to several hundred hours depending on the particular strength properties desired.

The inventive method also produces an aluminum-lithium wrought alloy product comprising shapes adaptable for further cold rolling or structural components such as those used in aircraft or aerospace use. For example, sheets, plates or extrusions may be fabricated using the inventive process. As will be described hereinafter, the final product exhibits increased strength and ductility in the transverse direction.

The aluminum-lithium alloy wrought product derived from the inventive method exhibits up to a 100% increase in percent elongation in the transverse direction as compared to conventional T8 temper practice. For example, an aluminum-lithium alloy subjected to conventional practice exhibits a percent elongation of only one percent in the transverse direction. In contrast, an aluminum-lithium alloy wrought product subjected to the inventive processing exhibits an average percent elongation in the transverse direction of 2%, a 100% increase over the conventional practice. Likewise, tensile yield stresses are also increased in aluminum-lithium alloy wrought products subjected to the inventive method as compared to conventional T8 temper practice. Thus, the aluminum-lithium alloy wrought products produced according to the inventive method offered design engineers a higher threshold limit for tensile yield stress and percent elongation for commercial application.

The following examples are presented to illustrate the invention but are not to be considered as limited thereto. In these examples and throughout the specification, parts are by weight unless otherwise indicated.

EXAMPLE 1

ALLOY SELECTION AND CASTING

An alloy of the following composition was DC cast into a 16" thick by 45" wide rectangular ingot.

| ALLOY I | | | | | | |
|---|---|---|---|---|---|---|
| Cu | Li | Mg | Zr | Fe | Si | Al |
| 3.62 | 1.62 | .37 | .15 | .03 | .03 | balance |

PROCESSING

The cast ingot that was processed conventionally, including stress relief and homogenization.

The homogenized ingot was then extruded to two 0.5" by 4" cross section rectangular bars by a two hole die using conventional extrusion parameters. A perspective view of the extrusion 10 is shown in FIG. 1.

The extruded rectangular bars were solution heat treated and cold water quenched to room temperature to a W-temper condition.

Temper Procedure: Cold work and artificial aging

The following experiments were conducted using both a conventional T8 temper practice and a first mode of the inventive method designated as Practice A.

The conventional T8 temper practice included stretching the W-temper extrusion by 6% in one step, unloading, and aging at 320° F. for 16 hours.

The Inventive Practice A is as follows

1. Stretch W-temper extrusion by 1.5% and unload,
2. Stretch additional 1.5% and unload, 3. Stretch additional 1.5% and unload,
4. Stretch additional 1.5% to make the total amount of stretch 6% and unload,
5. Age at 320° F. for 16 hours

MECHANICAL PROPERTY TESTING

Tensile specimens with 0.350" gauge diameter were machined in the longitudinal direction (L-direction) and in the transverse direction (T) relative to the extruded direction. The schematic diagram of the specimen layout is shown in FIG. 1, the longitudinal specimens designated as L1 and L2 with the transverse specimens designated as T1 and T2.

MECHANICAL PROPERTY TEST RESULTS

Tensile test results are listed in TABLE I and TABLE II. To ensure the reliability of the test results, duplicate tests were conducted for both the L and T direction tests.

Figure 4:
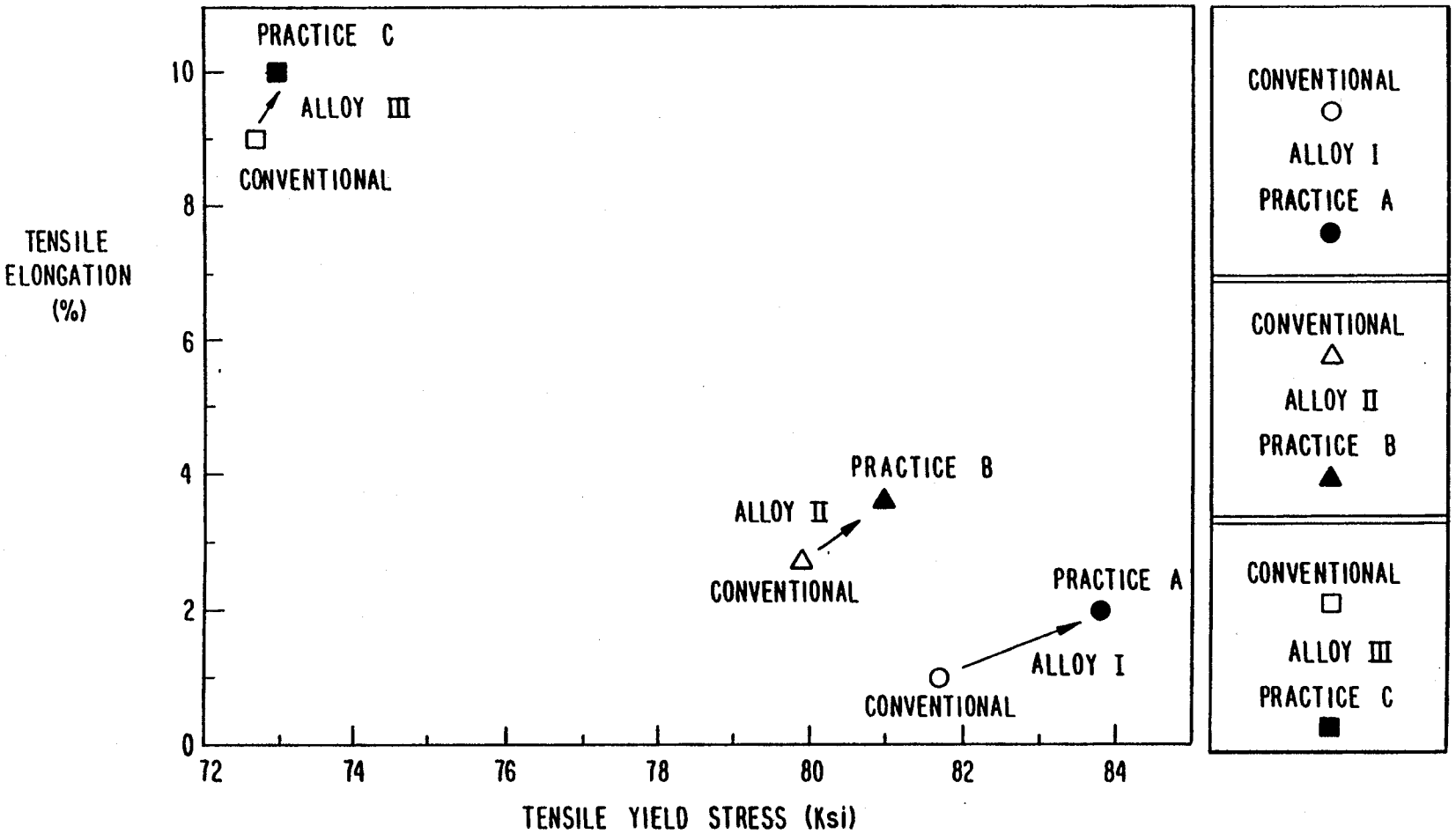
FIG. 4 is a graph comparing modes of the inventive method to prior art methods, the graph relating tensile elongation to tensile yield stress.

TABLE I illustrates the tensile test results of the extrusion which was processed by the conventional T8 temper practice (6% stretched in one step and aged at 320° F. for 16 hours). The averaged value for tensile yield strength in the T direction is only 81.7 ksi and the averaged value for tensile ductility in the T direction in only 1%. TABLE II illustrates the tensile test results of the extrusion which was processed according to the invention (Practice A). The averaged value for tensile yield strength in the T direction is 83.8 ksi which is higher by 2.1 ksi than that of conventionally processed extrusion and the averaged value for tensile ductility in the T direction is 2% which is twice that of the conventionally processed extrusion. FIG. 4 compares the results from TABLE I and TABLE II. The practice A improved both strength and ductility in the long transverse direction.

TABLE I

Tensile test results of Alloy I bar extrusions processed by conventional T8 temper practice Conventional Practice: 6% stretch in one step + age at 320° F. for 16 hours

| Direction | | UTS(ksi) | TYS(ksi) | El (%) |
|---|---|---|---|---|
| Longitudinal | | 90.7 | 88.5 | 8.0 |
| | | 90.7 | 88.5 | 8.0 |
| | average | 90.7 | 88.5 | 8.0 |
| Transverse | | 84.7 | 81.7 | 1.0 |
| | | 84.7 | 81.6 | 1.0 |
| | average | 84.7 | 81.7 | 1.0 |

TABLE II

Tensile test results of Alloy I bar extrusions processed according to a first mode of the inventive method Practice A: 1.5% stretch, unload + 1.5% stretch, unload + 1.5% stretch, unload + 1.5% stretch, unload + age at 320° F. for 16 hours

| Direction | | UTS(ksi) | TYS(ksi) | El (%) |
|---|---|---|---|---|
| Longitudinal | | 93.9 | 92.0 | 6.0 |
| | | 94.4 | 92.4 | 7.0 |
| | average | 94.2 | 92.2 | 6.5 |
| Transverse | | 87.0 | 83.8 | 1.0 |
| | | 86.9 | 83.7 | 3.0 |
| | average | 87.0 | 83.8 | 2.0 |

EXAMPLE 2

Alloy selection and casting

An alloy of the following composition was DC cast into a 16" thick by 45" wide rectangular ingot.

ALLOY 11

| Cu | Li | Mg | Zr | Fe | Si | Al |
|---|---|---|---|---|---|---|
| 4.61 | 1.02 | .36 | .13 | .05 | .03 | balance |

PROCESSING

The cast ingot was then processed conventionally, including stress relief and homogenization.

Figure 2:
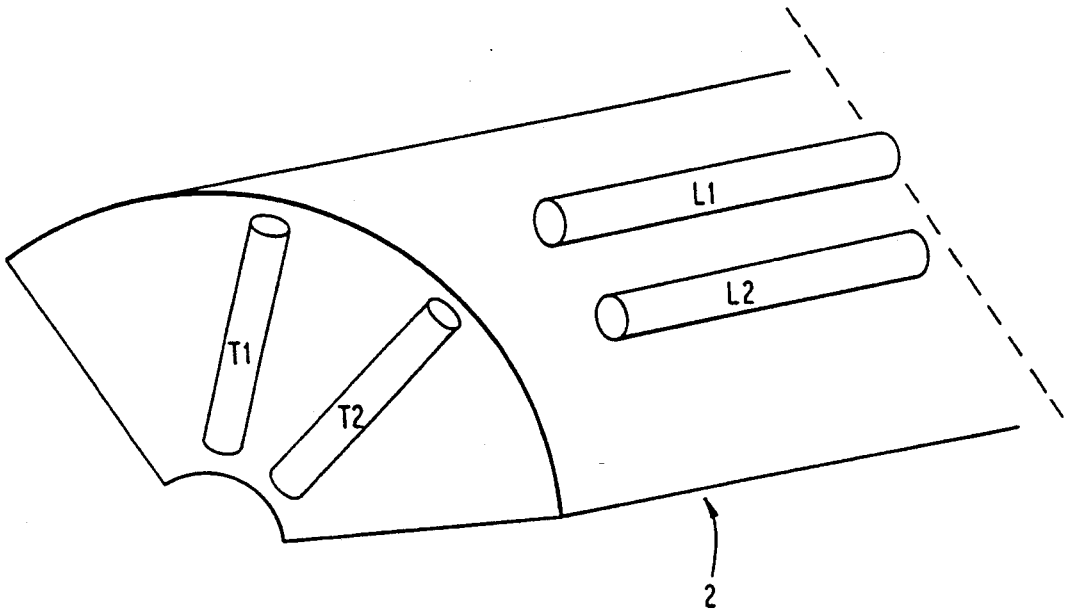
FIG. 2 is a perspective view of an aluminum-lithium 120° pie-shaped extrusion processed according to a second mode of the inventive method.

The homogenized ingot was machined into a billet and extruded to a 120° piece pie-shaped extrusion using conventional extrusion parameters. A perspective view of the extrusion 20 is shown in FIG. 2. The extruded bars were then solution heat treated and cold water quenched to a W-temper condition.

TEMPER PROCEDURE: Cold work and Artificial Aging

The following experiments were conducted using both the conventional T8 temper practice and a second mode of the inventive method designated as Practice B.

The conventional T8 Temper practice included stretching the W-temper extrusion by 6% in one step, unloading, and aging at 290° F. for 36 hours.

The Inventive Practice B is as follows:

1. Strength W-temper extrusion by 3.5 % and unload,
2. Stretch additional 2.5% and unload, then
3. Age at 290° F. for 36 hours

MECHANICAL PROPERTY TESTING

Duplicate tensile test specimens having 0.350" gauge diameter were machined in the longitudinal direction (L-direction) and duplicate tensile test specimens with 0.160" gauge diameter were machined in the transverse direction (T). The schematic diagram of the specimen layouts L1, L2, T1 and T2 are shown in FIG. 2.

MECHANICAL PROPERTY TEST RESULTS

Tensile test results for Example 2 are listed in TABLE III and TABLE IV. To ensure the reliability of the test results, duplicate tests were conducted for both L and T direction tests.

TABLE III illustrates the tensile test results of the extrusion which was processed by the conventional T8 temper practice (6% stretched in one step and aged at 290° F. for 36 hours). The averaged value for tensile yield strength in the transverse direction is 79.9 ksi and the averaged value for tensile ductility in the transverse direction is 2.7%. TABLE IV illustrates the tensile test result of the extrusion which was processed according to the invention (Practice B). The averaged value for tensile yield strength in the transverse direction is 81.0 ksi which is higher by 1.1 ksi than that of the conventionally processed extrusion. The averaged value for tensile ductility in the transverse direction is 3.6% which is higher by 30% than that of the conventionally processed extrusion. FIG. 4 compares the results from TABLE III and TABLE IV. The practice B demonstrates improved strength and ductility in the transverse direction.

TABLE III

Tensile test results for Alloy II extrusions processed by conventional T8 temper practice Conventional Practice: 6% stretch in one step + age at 290° F. for 36 hours

| Direction | | UTS(ksi) | TYS(ksi) | EL (%) |
|---|---|---|---|---|
| Longitudinal | | 105.4 | 105.3 | 6.4 |
| | | 101.2 | 100.9 | 7.9 |
| | average | 103.3 | 103.1 | 7.1 |
| Transverse | | 87.5 | 80.5 | 2.1 |
| | | 88.4 | 79.3 | 3.2 |
| | average | 88.0 | 79.9 | 2.7 |

TABLE IV

Tensile test results of Alloy II extrusions processed by according to a second mode of the inventive method Practice B: 3.5% stretch, unload + 2.5% stretch, unload + age at 290° F. for 36 hours

| Direction | | UTS(ksi) | TYS(ksi) | El (%) |
|---|---|---|---|---|
| Longitudinal | | 105.8 | 105.8 | 7.1 |
| | | 103.6 | 103.5 | 7.1 |
| | average | 104.7 | 104.6 | 7.1 |
| Transverse | | 88.7 | 81.1 | 3.6 |
| | | 89.2 | 81.0 | 3.6 |
| | average | 88.9 | 81.0 | 3.6 |

EXAMPLE 3

Alloy selection and casting

An alloy of the following composition was DC cast into a 16" thick by 45" wide rectangular ingot.

| ALLOY III | | | | | | |
|---|---|---|---|---|---|---|
| Cu | Li | Mg | Zr | Fe | Si | Al |
| 2.55 | 1.59 | .34 | .14 | .04 | .03 | balance |

PROCESSING

The cast ingot was then processed conventionally, including stress relief and homogenization. The homogenized ingot was machined into a billet for extrusion.

Figure 3:
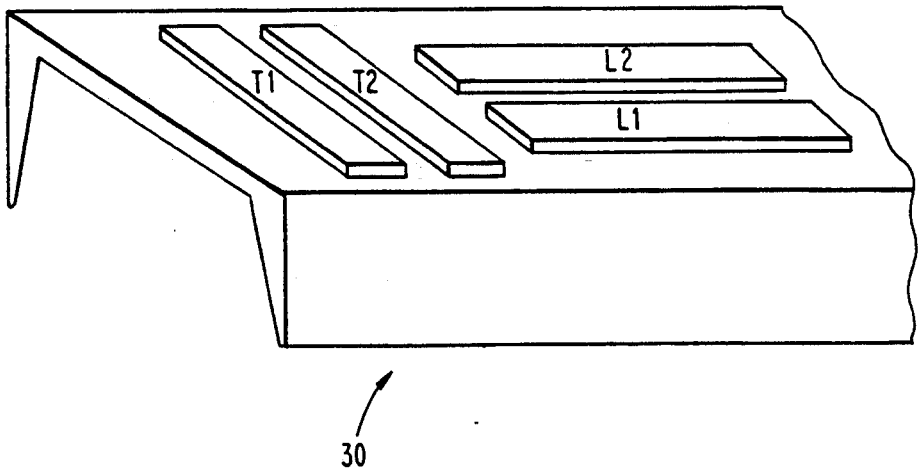
FIG. 3 is a perspective view of an aluminum-lithium alloy channel extrusion processed according to a third mode of the inventive method.

The billet was then extruded to a channel shaped extrusion using conventional extrusion parameters. A perspective view of the extrusion 30 is shown in FIG. 3.

The channel extrusion was then solution heat treated and cold water quenched to a W-temper condition.

Temper Procedure: Cold work and Artificial Aging

The following experiments were conducted using both the conventional T8 temper practice and a third mode of the inventive method.

The conventional T8 temper practice included stretching the W-temper extrusion by 3.5% in one step, unloading, and aging at 320° F. for 36 hours.

The Inventive Practice C is as follows:

1. Stretch W-temper extrusion by 2% and unload,
2. Stretch additional 1.5% and unload, then
3. Age at 320° F. for 36 hours

MECHANICAL PROPERTY TESTING

Duplicate tensile test specimens with 1" gauge length by 0.29"×.25" gauge cross section were machined in the longitudinal direction (L-direction) and duplicate tensile test specimens with 1" gauge length by .29"×.25" gauge cross section were machined in the transverse direction (T). The schematic diagram of the specimen layouts L1, L2, T1, and T2 are shown in FIG. 3.

MECHANICAL PROPERTY TEST RESULTS

Tensile test results are listed in TABLE V and TABLE VI. To ensure the reliability of the test results, duplicate tests were conducted for both the L and T direction tests.

TABLE V illustrates the tensile test result of the extrusion which was processed by the conventional T8 temper practice (3.5% stretched in one step and aged at 320° F. for 36 hours). The averaged value for tensile yield strength in the transverse direction is 72.7 ksi and the averaged value for tensile ductility in the transverse direction is 9.0%. TABLE VI illustrates the tensile test result of the extrusion which was processed according to the invention (Practice C). The averaged value for tensile yield strength in the transverse direction is 73 ksi which is higher by 0.3 ksi than that of the conventionally processed extrusion. The averaged value for tensile ductility in the transverse direction is 10% which is higher by 1% than that of the conventionally processed extrusion. FIG. 4 compares the results from TABLE V and TABLE VI. Practice C improves both strength and ductility in the transverse direction.

TABLE V

Tensile test results of Alloy III channel shape extrusion processed by conventional T8 temper practice Conventional Practice: 3.5% stretch in one step + age at 320° F. for 36 hours

| Direction | | UTS(ksi) | TYS(ksi) | EL (%) |
|---|---|---|---|---|
| Longitudinal | | 80.3 | 74.8 | 12.0 |
| | | 80.3 | 75.0 | 11.0 |
| | average | 80.3 | 74.9 | 11.5 |
| Transverse | | 77.4 | 72.6 | 10..0 |
| | | 77.5 | 72.9 | 8.0 |
| | average | 77.5 | 72.7 | 9.0 |

TABLE VI

Tensile test results of Alloy III channel extrusion processed according to a third mode of the inventive method Practice C: 2% stretch, unload + 1.5% stretch, unload + age at 320° F. for 36 hours

| Direction | | UTS(ksi) | TYS(ksi) | El (%) |
|---|---|---|---|---|
| Longitudinal | | 78.5 | 72.9 | 12.0 |
| | | 79.4 | 74.0 | 10.0 |
| | average | 78.9 | 74.4 | 11.0 |
| Transverse | | 77.8 | 73.0 | 10.0 |
| | | 77.9 | 72.9 | 10.0 |
| | average | 77.9 | 73.0 | 10.0 |

The above-described examples demonstrate the unexpected improvements in transverse direction strength and ductility in aluminum-lithium alloys when subjected to the improved T8 temper practice according to the invention. Subjecting these types of aluminum-lithium alloys to the multiple step stretching sequence between the solution heating and quenching steps and the aging step improves both strength and percent elongation in the transverse direction, thereby making these products more adaptable for use in applications for the aerospace and aircraft industry.

As such, an invention has been disclosed in terms of preferred embodiments thereof that fulfill each and every one of the objects of the present invention as set forth hereinabove and provide a new and improved T8 temper practice for aluminum-lithium alloy wrought products.

Various changes, modifications and alterations from the teachings of the present invention may be contemplated by those skilled in the art without departing from the intended spirit and scope thereof. Accordingly, it is intended that the present invention only be limited by the terms of the appended claims.

What is claimed is:

1. A method of improving transverse direction strength and ductility in a solution heat treated and quenched aluminum-lithium alloy wrought product comprising the steps of:

a) stretching said solution heat treated and quenched aluminum-lithium alloy wrought product an amount between 1 and 20 percent reduction in a plurality of stretching steps, and b) aging said stretched wrought product to increase its strength whereby said plurality of stretching steps increase strength and ductility in said wrought product in said transverse direction, said stretching occurring prior to any aging of the product.

2. The method of claim 1 wherein each of said plurality of stretching steps is equal in percent reduction.

3. The method of claim 1 wherein at least two of said plurality of stretching steps are unequal in percent reduction.

4. The method of claim 1 wherein said plurality of stretching steps further comprises four stretching steps, each stretching step having 1.5 percent reduction.

5. The method of claim 1 wherein said plurality of stretching steps further comprises two stretching steps, one step having 3.5 percent reduction and the other step having 2.5 percent reduction.

6. The method of claim 1 wherein said plurality of stretching steps further comprises two stretching steps, one step having 2 percent reduction and the other step having 1.5 percent reduction.

7. The method of claim 1 wherein said aluminum-lithium wrought product is selected from the group of aluminum-lithium-copper alloys, aluminum-lithium-magnesium alloys, aluminum-lithium-copper-magnesium alloys, aluminum-lithium-copper-magnesium-silver alloys, aluminum-lithium-copper-magnesium-silver-zinc alloys, aluminum-lithium-copper-magnesium-zinc alloys, aluminum-lithium-magnesium-zinc alloys, aluminum-magnesium-lithium-zinc-manganese alloys, and aluminum-magnesium-lithium-zinc-silver-manganese alloys.

8. The method of claim 7 wherein said aluminum-lithium alloy wrought product is an aluminum-copper-lithium-magnesium alloy.

9. The method of claim 1 wherein said percent reduction ranges between about 2 and 14 percent.

10. The method of claim 9 wherein said percent reduction ranges between about 3 and 10 percent.

11. A wrought aluminum-lithium wrought product made according to the method of claim 1 and having increased ductility and strength in a transverse direction thereof.

12. A wrought aluminum-lithium alloy product made according to the method of claim 2 and having increased ductility and strength in a transverse direction thereof.

13. A wrought aluminum-lithium alloy product made according to the method of claim 3 and having increased ductility and strength in a transverse direction thereof.

14. The wrought aluminum-lithium product of claim 11 wherein said wrought product is an extrusion, sheet or plate.

15. The wrought aluminum-lithium product of claim 12 wherein said wrought product is an extrusion, sheet or plate.

16. The wrought aluminum-lithium product of claim 13 wherein said wrought product is an extrusion, sheet or plate.

17. A method of improving transverse direction strength and ductility in a solution heat treated and quenched aluminum-lithium alloy wrought product having copper, magnesium and zirconium as main alloying components, said method comprising the steps of:

a) stretching said solution heat treated and quenched aluminum-lithium alloy wrought product an amount between 1 and 20 percent reduction in a plurality of consecutive stretching steps, and b) aging said stretched wrought product to increase its strength whereby said plurality of consecutive stretching steps increase strength and ductility in said wrought product in said transverse direction.

18. The method of claim 17 wherein the aluminum-lithium alloy includes silver as an alloying component.

19. The method of claim 17 wherein said stretching occurs prior to any aging of the product.

* * * * *